US007584587B2

(12) United States Patent
Ouellette et al.

(10) Patent No.: US 7,584,587 B2
(45) Date of Patent: Sep. 8, 2009

(54) APPARATUS FOR AIDING IN THE INSTALLATION AND SEALING OF SIDING

(75) Inventors: Richard D. Ouellette, Jupiter, FL (US); Thomas A. DeBono, Jupiter, FL (US)

(73) Assignee: Tropical Star, Inc., Jupiter, FL (US)

( * ) Notice: Subject to any disclaimer, the term of this patent is extended or adjusted under 35 U.S.C. 154(b) by 116 days.

(21) Appl. No.: 11/681,348

(22) Filed: Mar. 2, 2007

(65) Prior Publication Data

US 2008/0209851 A1 Sep. 4, 2008

(51) Int. Cl.
*E04B 1/00* (2006.01)

(52) U.S. Cl. ..... 52/749.1; 52/547; 33/646; 33/647

(58) Field of Classification Search ..... 52/520, 52/547, 549, 468, 396.08, 369.1, 741.4, 749.1, 52/749.11, DIG. 1; 277/650, 906, 921; 33/646, 33/647; 403/10, 203, 226, 267, 286, 331, 403/363, DIG. 10, DIG. 15
See application file for complete search history.

(56) References Cited

U.S. PATENT DOCUMENTS

| | | | | | |
|---|---|---|---|---|---|
| 1,446,858 | A | | 2/1923 | Rachlin | |
| 1,477,167 | A | | 12/1923 | Fischer | |
| 1,483,735 | A | | 2/1924 | Kridler et al. | |
| 1,692,388 | A | | 11/1928 | Schollmeyer | |
| 2,488,326 | A | | 11/1949 | Pratt | |
| 2,495,303 | A | * | 1/1950 | Wisniewski | 52/468 |
| 2,511,083 | A | | 6/1950 | Small | |
| 2,519,656 | A | | 8/1950 | Howe | |
| 2,685,852 | A | * | 8/1954 | Godel | 52/16 |
| 2,766,861 | A | * | 10/1956 | Abramson | 52/531 |
| 2,988,854 | A | * | 6/1961 | McKinley | 52/639 |
| 3,143,828 | A | * | 8/1964 | Bowman | 52/520 |
| 3,166,872 | A | | 1/1965 | Cacossa | |
| 3,222,831 | A | | 12/1965 | Pritchard | |
| 3,327,446 | A | * | 6/1967 | Tracy | 52/547 |
| 3,606,418 | A | * | 9/1971 | Buker | 403/363 |

(Continued)

FOREIGN PATENT DOCUMENTS

| | | |
|---|---|---|
| JP | 2002047781 | 2/2002 |

(Continued)

*Primary Examiner*—Robert J Canfield
*Assistant Examiner*—Matthew J Gitlin
(74) *Attorney, Agent, or Firm*—Darby & Darby PC; Robert J. Sacco

(57) ABSTRACT

An apparatus (100) for aiding in the installation of successive horizontal layers of siding members (150) to a sidewall construction (50) of a building. The apparatus also seals the vertical and horizontal seams between adjoining and successive horizontal layers of the siding members (150). In the exemplary embodiment of the invention, the apparatus (100) is used to aid in the installation and sealing of siding members (150) comprised of a fiber cement composite material. The fiber cement composite siding members (150) are heavier than traditional siding pieces and require more than one person to lift for installation. With the use of the apparatus (100), successive horizontal layers of composite siding members (150) can be installed on the sidewall construction (50) by a single person. One or more sealing members (107) secure and seal the siding members (150) to the apparatus (100) and provide a moisture impervious seal between adjoining and successive horizontal layers of the siding members (150).

19 Claims, 5 Drawing Sheets

U.S. PATENT DOCUMENTS 3,818,668 A * 6/1974 Charniga ..... 52/547
4,067,155 A * 1/1978 Ruff et al. ..... 52/105
4,155,175 A * 5/1979 Stiles ..... 33/646
4,208,799 A * 6/1980 Frantello ..... 33/647
4,229,913 A * 10/1980 Corrigan ..... 52/38
4,292,781 A 10/1981 Chalmers et al.
4,314,429 A * 2/1982 Casteel et al. ..... 52/127.2
4,432,181 A * 2/1984 Funaki ..... 52/459
4,553,363 A 11/1985 Weinar
4,624,088 A * 11/1986 Arent ..... 52/506.07
4,650,702 A * 3/1987 Whitmyer ..... 428/31
4,691,489 A * 9/1987 Shea, Jr. ..... 522/35
4,698,942 A 10/1987 Swartz
4,703,604 A * 11/1987 Muller ..... 52/741.4
4,835,916 A * 6/1989 Steadman ..... 52/28
4,924,647 A * 5/1990 Drucker ..... 52/235
D318,608 S 7/1991 Schenker
D360,355 S 7/1995 Adams
5,465,499 A * 11/1995 LaPlante ..... 33/647
5,519,969 A 5/1996 Golba
5,522,149 A * 6/1996 Meyer ..... 33/646
5,560,170 A * 10/1996 Ganser et al. ..... 52/539
5,564,245 A 10/1996 Rademacher
5,651,225 A * 7/1997 Leeks ..... 52/461
6,032,426 A * 3/2000 Tamlyn ..... 52/483.1
6,069,342 A * 5/2000 Amador et al. ..... 219/388
6,148,569 A * 11/2000 Giovannetti ..... 52/127.11
6,301,856 B1 * 10/2001 Nasi ..... 52/712
6,336,300 B1 * 1/2002 Babucke ..... 52/396.04
6,615,560 B2 * 9/2003 Ito ..... 52/506.06
6,725,619 B1 4/2004 Barber
D494,844 S 8/2004 Klein et al.
6,857,243 B2 2/2005 Bloomfield
6,932,310 B1 * 8/2005 Diss ..... 248/301
7,021,018 B2 * 4/2006 Peng ..... 52/549
D552,269 S * 10/2007 Vibiano ..... D25/164
7,490,447 B2 * 2/2009 Ouellette et al. ..... 52/749.1
2001/0005965 A1 * 7/2001 Beck ..... 52/519
2001/0032395 A1 * 10/2001 Pyburn ..... 33/647
2002/0174618 A1 11/2002 Carroll
2003/0033771 A1 2/2003 Anderson
2003/0159399 A1 * 8/2003 Werren ..... 52/749.1
2004/0237443 A1 12/2004 Haley et al.
2005/0005576 A1 1/2005 Ruston
2005/0193674 A1 * 9/2005 Hatkoff ..... 52/561
2005/0204691 A1 * 9/2005 Elar ..... 52/749.1
2005/0252139 A1 * 11/2005 Pringle et al. ..... 52/521
2005/0262792 A1 12/2005 Walda
2006/0101780 A1 * 5/2006 Duterte ..... 52/749.1
2007/0056238 A1 * 3/2007 Albracht ..... 52/522
2009/0031652 A1 * 2/2009 Ortega Gatalan ..... 52/235

FOREIGN PATENT DOCUMENTS

JP 2002047781 A * 2/2002

* cited by examiner

APPARATUS FOR AIDING IN THE INSTALLATION AND SEALING OF SIDING

BACKGROUND OF THE INVENTION

1. Statement of the Technical Field

The invention relates to an apparatus for aiding in the installation and sealing of siding on a building. More particularly, this invention relates to an apparatus for siding in the installation of successive horizontal layers of fiber cement composite siding on a sidewall construction of a building. The apparatus also seals the vertical and horizontal seams between adjoining and successive horizontal layers of the siding.

2. Description of the Related Art

The construction industry continues to seek improvements in the materials and processes by which buildings such as homes, office buildings, and shopping malls are constructed. For example, one recent improvement has been the use of siding made from non-traditional materials such as fiber cement or composite materials instead of traditional wood, aluminum or vinyl siding. Fiber cement composite siding is made of sand, cement, and cellulose fibers. Fiber cement composite siding offers the appearance of traditional wood-based siding materials with much lower maintenance requirements, while maintaining its shape and color much better than vinyl siding. It's available in a variety of textures, profiles, and colors to match individual design requirements. Fiber cement composite siding manufacturers offer complete systems for siding, decorative shapes, soffit and trim applications. About 12% to 15% of all new homes are now clad with fiber cement composite siding.

In addition, the fiber cement composite siding doesn't warp, buckle, or fade like vinyl siding products and holds a Class 1 (A) Fire Rating. Fiber cement composite siding will not rot, is capable of withstanding damaging effects of salt spray and ultraviolet rays, and cannot be penetrated by birds or insects. Once installed, the composite concrete siding stands up to bumps and direct impacts, unlike aluminum siding, and doesn't become brittle in freezing conditions or melt in the presence of heat sources, like barbeque grills, as does vinyl siding. Fiber cement composite siding holds paint well, with some siding products warranted to hold paint for up to twenty-five years.

There are drawbacks to the use of fiber cement composite siding instead of traditional wood, aluminum, and vinyl siding. For example, special tools and expertise are required to install it. In addition, the fiber cement composite siding pieces weigh more than traditional wood, aluminum, and vinyl siding pieces. The additional weight requires more labor to install. Typically, two or more persons are required to lift and hold the aiding pieces in place while securing them to the sidewall construction. One other drawback with the use of fiber cement composite siding and other types of siding is that moisture can get between the siding and the sidewall construction by infiltrating the abutting end joints and horizontal seams. The moisture can cause wood siding or the sidewall construction materials to rot or the moisture can freeze and expand forcing the siding to detach from the sidewall construction.

There are brackets known in the art for aiding in the installation of successive layers of traditional siding materials to a sidewall construction of a structure. For example, in U.S. published patent application serial No. 2002/0174618 to Carroll, there is an apparatus for installing siding over a wall composed of spaced apart studs and for forming an interlock of the siding and for providing easy installation and for resistance to high winds and for allowing waters to drain therefrom comprising an upside down U-shaped receiving member for being clipped on a first siding plank and connected to a second U-shaped receiving member with the second U-shaped receiving member being faced for receiving a second siding plank for creating the desired over lap relationship between the first and second siding planks. One form of the apparatus has a substantially U-shaped aperture formed therein for avoiding the studs when clipped on a siding plank. Another form of the apparatus has a second up side down U-shaped receiving member for being clipped on factory created end joints which may meet at any location on the wall without regard to the studs to form a joint.

Another example is shown in U.S. Pat. No. 4,208,799 where a siding gauge is used to enable one man to install successive layers of board siding or other types where a one inch or other predetermined overlap is required. The gauge also ensures the siding is level. The gauge comprises a pair of J shaped members joined base to base, one inverted relative to the other.

A further example is shown Japanese patent publication JP2002047781 to Takeshi which discloses a bracket for attaching siding to an external wall. The bracket also serves to prevent infiltration of water into the joint portion of the siding. The bracket is comprised of a main body, an engaging portion, and a watertight material stuck to an area astride the main body. The watertight material is arranged on each of right and left ends of a first engaging piece of the engaging portion, and stuck to the area astride a support portion of the main body, and the horizontal piece and the first engaging piece of the engaging portion.

None of the prior art devices are for use with the fiber cement composite siding. In view of the forgoing, there remains a need for an apparatus for aiding in the installation of fiber cement composite siding which reduces the labor required to install the siding. Particularly, there remains a need for an apparatus for aiding in the installation of fiber cement composite siding which allows one person to install the siding. In addition, the apparatus must seal the vertical seam between adjoining siding boards and the horizontal seams between successive layers of the siding boards to prevent moisture from infiltrating behind the siding boards.

SUMMARY OF THE INVENTION

An apparatus for aiding in the installation of successive horizontal layers of siding members to a sidewall construction is provided. The apparatus also seals the vertical seam between adjoining siding boards and the horizontal seams between successive layers of the siding boards. In the exemplary embodiment of the invention, the apparatus is used to aid in the installation and sealing of fiber cement composite siding. The apparatus is comprised of a planar body having a first, second, third, and fourth peripheral edge. There is at least a first channel disposed outwardly and upwardly from a first surface of the planar body. There is a third channel disposed outwardly and downwardly from a second surface of the planar body. The third channel is disposed horizontally on the second surface and disposed a predetermined distance from the third edge of the planar body.

The apparatus further comprises a strip disposed vertically on the first surface of the planar body dividing the planar body into symmetric first and second portions. The strip is comprised of a resilient material that is a member of the group consisting of butyl rubber or a polymer.

In the exemplary embodiment of the apparatus, the at least first channel is two channels. One of the two channels is disposed outwardly and upwardly from the first portion along the fourth edge of the planar body. The other of the two channels is disposed outwardly and upwardly from the second portion along the fourth edge of the planar body. Each of the two channels define a recess configured to receive one end of adjoining siding members defining a second siding layer of the sidewall construction.

The predetermined distance the third channel is disposed from the third edge of the planar body is in a range from between greater than zero to a distance less than the distance between the third and fourth edges of the planar body. The third channel is disposed a distance in the range of greater than zero inches to one and one-eighth inches from the fourth edge of the planar body. The third channel defines a recess configured for attaching to a first edge of a siding member defining a first siding layer of the sidewall construction.

In the exemplary embodiment of the invention, the at least first channel is u-shaped and has a width of one-quarter inch. The third channel is u-shaped and has a width of one-quarter inch. The strip has a width in the range of between one-quarter and one-thirty second inches. The at least first channel has a length in the range of greater than zero to one inch. The planar body has a length between the first and second edges in the range of between greater than zero and three inches. The planar body, the at least first channel, and the third channel are comprised of a material that is a member of the group consisting of plastic, metal and composite. The at least first channel can be removed to eliminate an otherwise unsightly appearance of the installed siding.

There is at least one sealing member disposed adjacent to at leas tone of the third channel and the at least first channel. The at least one sealing member adheres and seals the siding members to the planar body adjacent to the third channel and the at least first channel. The at least one sealing member is comprised of an adhesive strip with a peel-off backing or a liquid adhesive. The sealing member aids in sealing the abutting ends of the adjacent siding members and the horizontal seams between successive siding layers to prevent moisture from penetrating behind the siding members.

BRIEF DESCRIPTION OF THE DRAWINGS

Embodiments will be described with reference to the following drawing figures, in which like numerals represent like items throughout the figures, and in which.

DETAILED DESCRIPTION OF THE PREFERRED EMBODIMENTS

Figure 1:
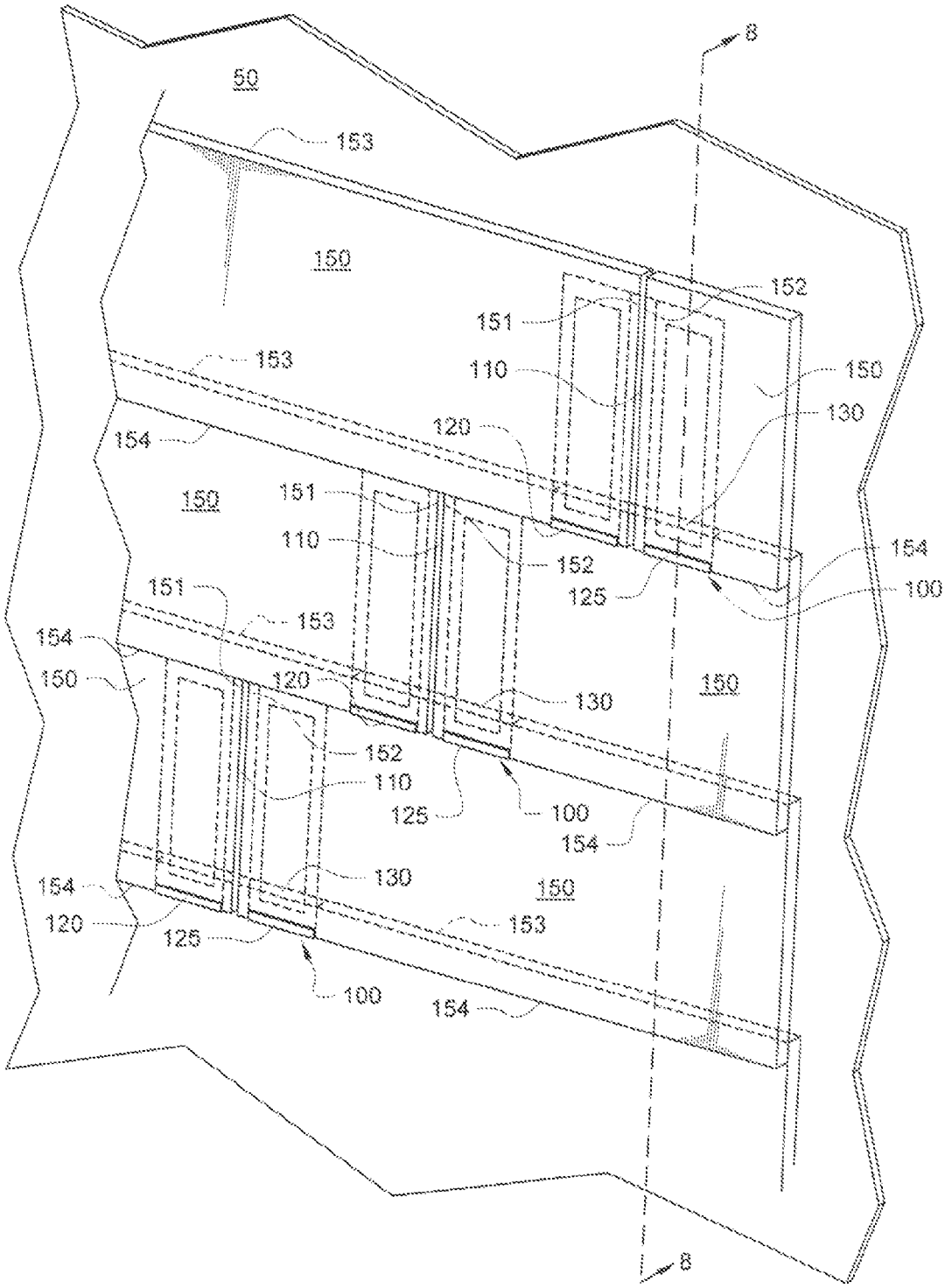
FIG. 1 is a front perspective view of an exemplary portion of a sidewall construction showing the intended use of an exemplary embodiment of an apparatus for aiding in the installation and sealing of successive horizontal layers of a siding material to the sidewall construction.

Referring to FIG. 1, shown is an exemplary portion of a sidewall construction 50 of a building under construction having an array of elongated, overlapping, and interlocking horizontal siding members 150 installed thereon. The array of siding members 150 defines an exterior, weather resistant protective layer to the sidewall construction 50. In the exemplary embodiment of the invention, the array of siding members 150 are fiber cement composite siding boards. However, the invention is not limited in this regard as other siding members made from other materials may be used. The siding members 150 are similar to traditional siding members used as an exterior protective layer on a sidewall construction.

The siding members 150 are typically available in one-quarter to one-half inch thicknesses, six to sixteen inch heights, and in standard length sizes up to sixteen feet. However, the invention is not limited in this regard as siding members manufactured in other thicknesses, widths, and lengths known to one of ordinary skill in the art could be used.

The array of horizontal siding members 150 are interconnected at abutting left and right ends 151, 152 of adjacent siding members 150 by one or more apparatuses 100. Traditionally, abutting horizontal siding members 150 are installed so that there is a gap separating the left and right ends of abutting siding members 150. The apparatuses 100 also interconnect successive horizontal layers of siding members 150.

Each apparatus 100 has a vertical resilient strip 110 separating the abutting left and rights ends 151, 152 of adjacent siding members 150. Traditionally, abutting horizontal siding members 150 are installed so that there is a gap separating the left and right ends 151, 152 of abutting siding members 150. The gap allows the abutting siding members to expand when the ambient temperature rises. Unfortunately, this gap also allows moisture to penetrate behind the adjoining siding members 150 and the siding layer disposed beneath the adjoining siding members 150. When an apparatus 100 is used for installing the adjacent siding members 150, the resilient strip 110 is inserted into the gap. The resilient strip allows the adjoining siding members to expand when the ambient temperature rises while maintaining a moisture impervious seal therebetween at all times.

Each apparatus 100 comprises a first channel 120 for receiving the bottom edge 154 of a right end 151 of the siding member 150. Each apparatus 100 also comprises a second channel 125 for receiving the second or bottom edge 154 of a left end 152 of the siding member 150. Each apparatus 100 further comprises a third channel 130 (best seen in FIGS. 4 and 7) for interconnecting the apparatus 100 to the first or top edge 153 of a the siding member 150 disposed beneath the adjacent siding members 150 interconnected by the apparatus 100.

A sealing member 107 is disposed adjacent the resilient strip 110 on each of the opposing sides of the resilient strip 110 on the apparatus 100. The siding member 107 secures and seals the abutting left and right ends 151, 152 of the siding member 150 to the front surface of apparatus 100.

Figure 2:
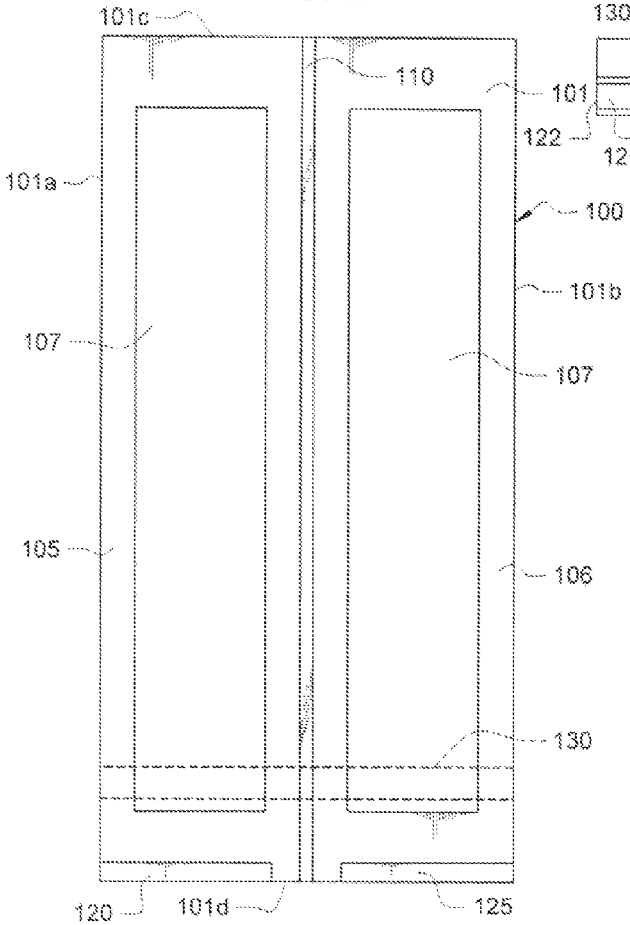
FIG. 2 is a front view of the apparatus of FIG. 1.
Figure 3:
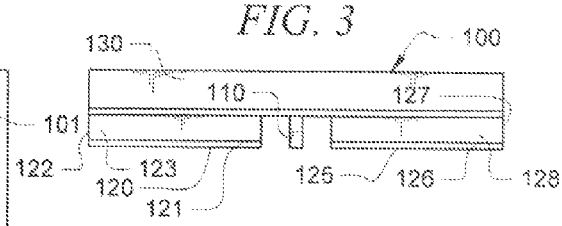
FIG. 3 is a top view of the apparatus of FIG. 2.
Figure 5:
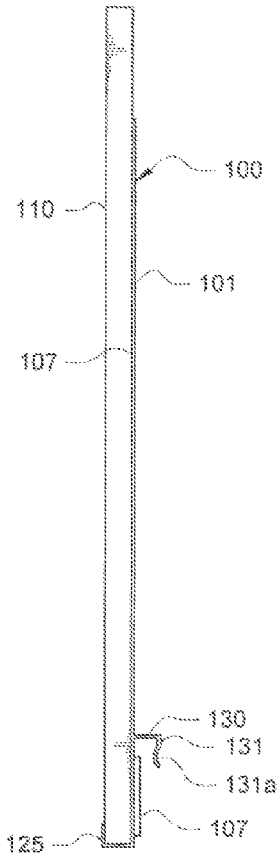
FIG. 5 is a right side view of the apparatus of FIG. 2.
Figure 4:
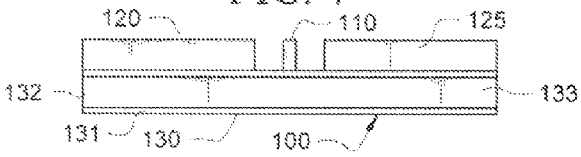
FIG. 4 is a bottom view of the apparatus of FIG. 2.

Referring now to FIGS. 2-5, shown are various vies of an exemplary embodiment of an apparatus 100 used for aiding in the installation of composite concrete siding. FIG. 2 shows a front view of the apparatus 100 while FIG. 3 shows a top view thereof, FIG. 4 shows a bottom view thereof, and FIG. 5 shows a right side view thereof. The apparatus 100 is made from a material such as plastic, metal or a composite of varying height. However, the invention is not limited in this regard as other materials known to one of ordinary skill in the art can be used.

The height of the apparatus 100 is selected to match the height of the siding members 150 chosen for the particular sidewall construction 50 (FIG. 1). In the exemplary embodiment of the invention, the length of the apparatus 100 is three inches in length. However, the invention is not limited in this regard as the length of the apparatus can vary according to such factors as the height of the siding and design preference.

The apparatus 100 is comprised of a rectangular planar body 101 dividing the planar body 101 into symmetric first and second portions 105, 106 by the resilient strip 110. The planar body 101 is comprised of a left or first peripheral edge 101*a*, a right or second peripheral edge 101*b*, a third or top peripheral edge 101*c*, and a bottom or fourth peripheral edge 101*d*.

The resilient strip 110 is comprised of a material such as butyl rubber or a polymer and is approximately one-quarter inch in height and one-thirty-second inch in width. However, the invention is not limited in this regard as the material selected for the resilient strip could be comprised of other materials known to one with ordinary skill in the art.

The first channel 120 is for receiving the bottom edge 154 of the right end 151 of a siding member 150 (FIG. 6) and interconnecting the siding member 150 to the apparatus 100 to the left of the resilient strip 110. The second channel 125 is for receiving the bottom edge 154 of the left end 152 of an adjoining siding member 150 (FIG. 6) and interconnecting the siding member 150 to apparatus 100 to the right of the resilient strip 110.

The first channel 120 and second channel 125 are "u" shaped and are formed along the bottom edge of the planar body 101. The first channel 120 and second channel 125 are approximately one-quarter inch in width for receiving the respective bottom edges 154 of adjacent siding members 150. However, the invention is not limited in this regard as the shape and width of the first channel 120 and second channel 125 could vary according to the shape and thickness of the particular siding member 150 selected. The first channel 120 is comprised of a lip 121 and a ledge 122 defining a recess 123 (FIG. 3). Similarly, the second channel 125 is comprised of a lip 126 and a ledge 127 defining a recess 127 (FIG. 3).

As discussed, a sealing member 107 is disposed adjacent the resilient strip 110 on each of the first and second portions 105, 106 on opposing sides of the resilient strip 110. The sealing members 107 secure the abutting left and right ends 151, 152 of adjacent siding members 150 (FIG. 6) to the apparatus 100. The sealing members 107 can be comprised of an adhesive strip having a peel-off backing or other adhesive such as a liquid adhesive. However, the invention is not limited in this regard as other sealing or adhesive means could be used known to one with ordinary skill in the art.

There is a third channel 130 disposed on a rear surface of the planar body 101. The third channel 130 (also seen in FIG. 7) is for interconnecting the apparatus 100 to the top edge 153 of a siding member 150 (FIG. 7) disposed beneath the adjacent siding members 150 interconnected by the apparatus 100. The third channel 130 is disposed downwardly on the rear surface of the planar body 101 approximately one and one-eight inch from the bottom edge of the planar body 101. The third channel 130 is also u-shaped and is approximately one-quarter inch in width and extends the length of the planar body 101. However, the invention is not limited in this regard as the location, shape and width could vary according to the shape and thickness of the siding members 150 selected for the particular sidewall construction 50.

The third channel 130 is further comprised of a lip 131 disposed downwardly from a ledge 132 which collectively define a recess 133. The recess 133 is configured for receiving the first or top edge 153 of a siding member 150 (also see FIG. 7) in the siding layer beneath the siding layer comprised of the siding members 150 being joined by the apparatus 100. The lip 131 further comprises a resilient undulation 131*a* which curves toward the planar body 101. The undulation 131*a* aids in gripping the first or top edge 153 of a siding member 150 (FIG. 7) to attach the apparatus 100 thereto.

Figure 7:
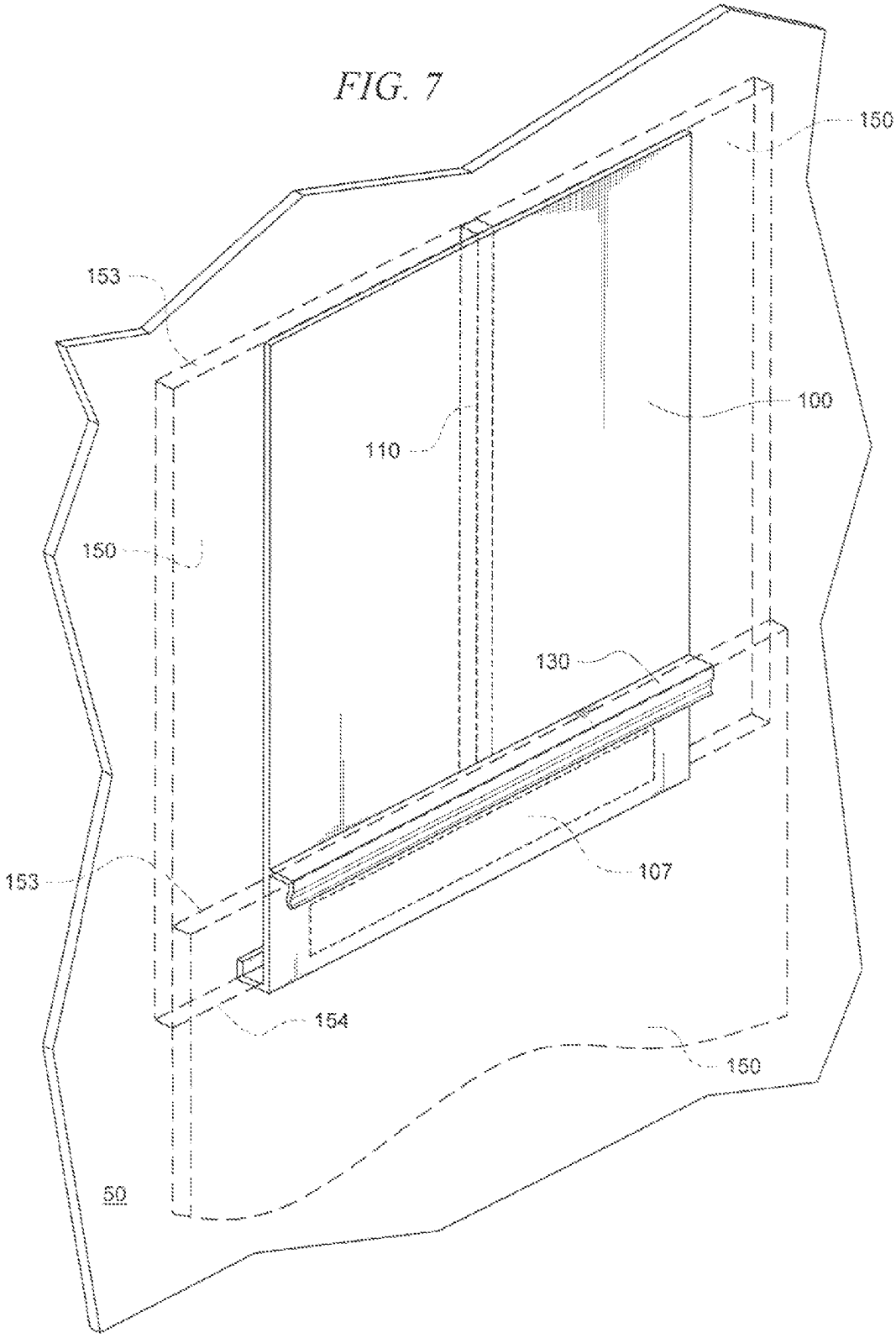
FIG. 7 is a rear perspective view showing an exemplary portion of a sidewall construction showing the intended use of a single apparatus for aiding in the installation of two successive horizontal layers of a siding material to a sidewall construction.

There is a sealing member 107 disposed between the third channel 130 and the bottom edge of the planar body 101 (shown also in FIG. 7). The sealing member 107 could be an adhesive strip with a peel-off backing or other adhesive. In the exemplary embodiment of the invention, the sealing member 107 is an adhesive strip that is approximately three-quarters of an inch in width. However, the invention is not limited in this regard as the sealing means and dimension of the sealing member 107 could vary as is known to one with ordinary skill in the art.

Figure 6:
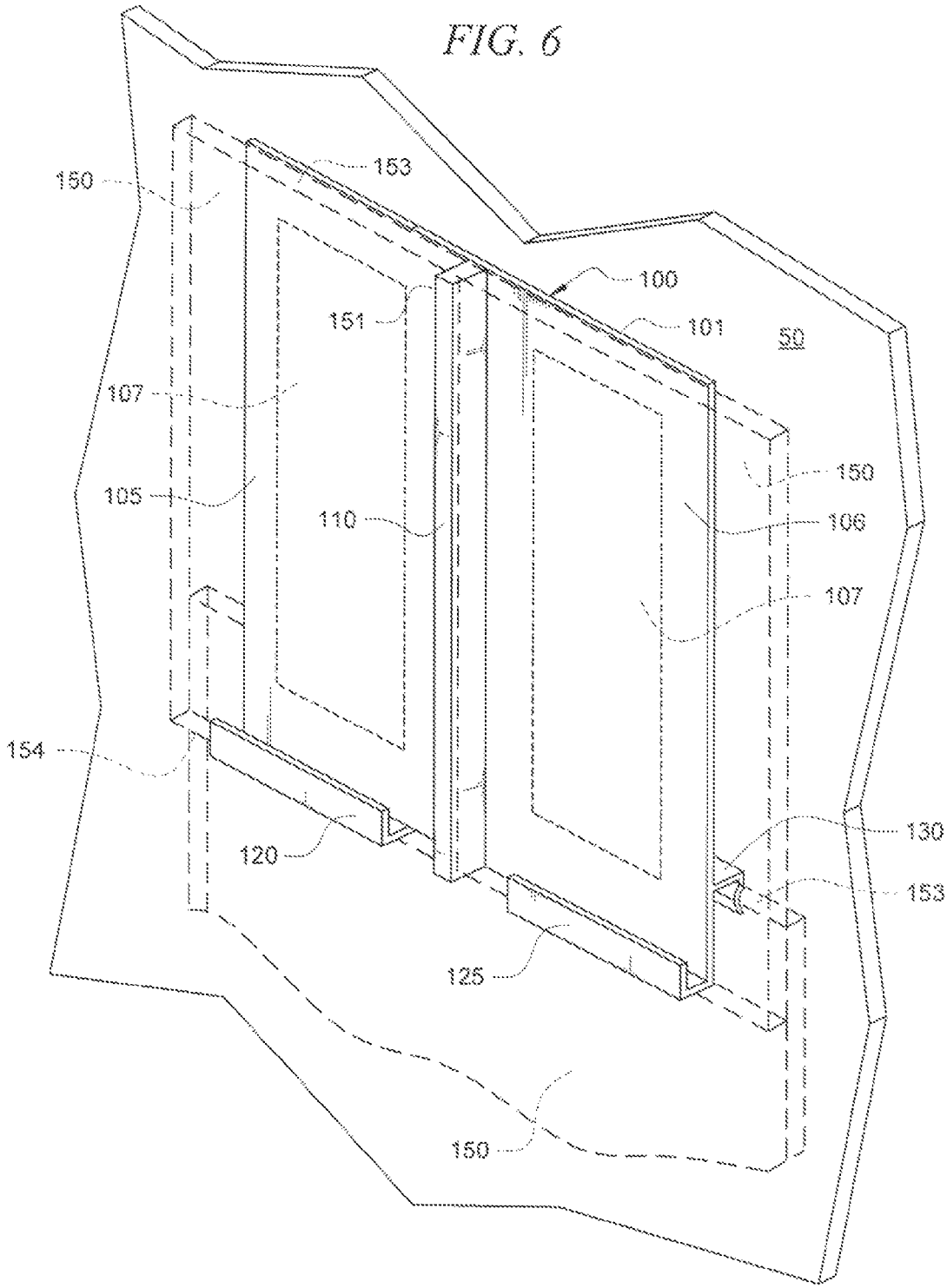
FIG. 6 is a front perspective view showing an exemplary portion of a sidewall construction showing the intended use of a single apparatus for aiding in the installation of two successive horizontal layers of a siding material to a sidewall construction.

Referring now to FIGS. 6 and 7, shown are respective front and rear perspective views of an exemplary portion of a sidewall construction 50 wherein two successive horizontal siding layers are installed to illustrate the use of the apparatus 100 in the installation. The two successive horizontal siding layers are defined by a first layer disposed beneath a second layer. The first layer is defined by a single continuous siding member 150. The first layer may be the lowermost siding layer on a sidewall construction 50 or it could be a preceding layer that already has been installed on the sidewall construction 50. Typically, successive horizontal first and second siding layers are staggered so that abutting left and right ends 151,152 of the siding members 150 are not disposed vertically in the immediate vicinity of one another (see FIG. 1).

Prior to the installation of the second siding layer, one or more of the apparatus 100 is attached to the top edge 153 (best seen in FIG. 7) of the siding member 150 comprising the first siding layer previously installed on the sidewall construction 50. The apparatus 100 is attached to the top edge 153 of the siding member 150 comprising the first siding layer by attaching the third channel 130 to the top edge 153. Just prior to attaching the third channel 130 to the top edge 153 of the siding member 150 comprising the first siding layer, the peel-off backing from the sealing member 107 disposed beneath the third channel 130 is removed. The sealing member 107 can now adhere the rear side of the planar body 101 of the apparatus 100 to the front surface of the siding member 150 near the top edge 153. The apparatus 100 is pressed against the siding member 150 to aid sealing member 107 adhering the rear side of the planar body 101 to the front surface of siding member 150 near the top edge 153.

A fastening means such as nails (not shown) or an adhesive (not shown) can also be used to secure the apparatus 100 and the aiding member 150 to the sidewall construction 50. However, the invention is not limited in this regard as any fastening means could be used as recommended by the manufacture of the siding members 150 or known to one of ordinary skill in the art.

With one or more of the apparatuses 100 attached on the top edge 153 of the siding member 150 comprising the first siding layer, another siding member 150 defining the second siding layer can be installed above the first siding layer by inserting the bottom edge 154 of the right end 151 of the siding member 150 into the first channel 120. Prior to the right end 151 of the siding member 150 being inserted into the first channel 120, the peel-off backing from the respective sealing member 107 is removed. The sealing member 107 adheres and seals the front of planar body 101 to the rear surface of the siding member 150. The right end 151 of siding member 150 is fitted snugly against resilient strip 110 to form a seal. The bottom edge 154 of the left end 152 of the siding member 150 can now be installed in the second channel 125 of another apparatus 100 (if installed) disposed to the left of the apparatus 100. The right end 151 of the siding member 150 can be pushed to aid sealing member 107 in adhering the right end 151 to the planar body 101.

Another siding member 150 is installed on the sidewall construction to define the second layer by the bottom edge 154 of the left end 152 of the siding member 150 being inserted into the first channel 125. Prior to the left end 152 of the siding member 150 being inserted into the second channel 125, the peel-off backing from sealing member 107 is removed so that sealing member 107 can adhere the front of planar body 101 to the rear surface of the siding member 150. The left end 152 of the siding member 150 can be pressed to aid sealing member 107 in adhering the left end 152 to the planar body 101. The right end 151 of the siding member 150 is inserted into the first channel 120 of another apparatus 100 (if installed) disposed to the right of the apparatus 100. Thus, an exemplary portion of a sidewall construction 50 wherein two successive horizontal siding layers are installed using the apparatus 100 to aid in the installation is complete.

If desired, after the installation of the siding member 150 defining the second siding layer, the first and second channels 120, 125 can be removed to prevent an otherwise unsightly appearance of the first and second channels 120, 125 on the siding. The first and second channels 120, 125 can be removed by breaking or snapping them off from the planar body 101.

With the use of the apparatus 100 as described, successive horizontal siding layers can be installed on a sidewall construction 50 of an entire building. The use of the apparatus 100 to aid in the installation of the successive horizontal siding layers allows one person to install the heavy fiber cement siding pieces. In addition, the apparatus 100 forms a seal between the successive horizontal first and second siding layers in the proximal area where the abutting right and left ends 151, 152 of the upper second siding layer join. The apparatus 100 also forms a seal at the vertical seam between the abutting left and right ends 151, 152 of the adjoining siding members 150. The abutting right and left ends 151, 152 are fitted snugly against the resilient strip 110 to form a seal. The sealing members 107 also contribute to sealing the left and right ends 151, 152 and the top edge 153 of the siding member 150 comprising the first siding layer and the bottom edges 154 of the adjoining siding members 150 comprising the second siding layer together to form a moisture impervious joint. This virtually eliminates the need for caulking.

Figure 8:
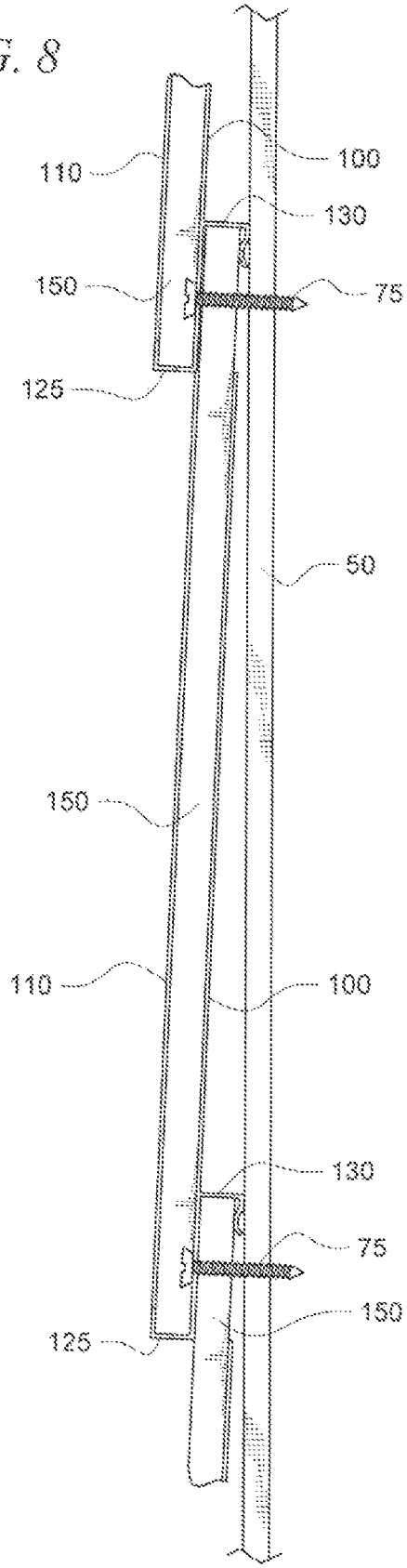
FIG. 8 is a cross-sectional side view taken along line 8-8 if FIG. 1 of the exemplary portion of a sidewall construction having successive horizontal layers of siding members installed with the aid of the apparatus.

Referring now to FIG. 8, shown is a cross-sectional side view taken along line 8-8 of FIG. 1 of the exemplary portion of a sidewall construction 50 having successive horizontal layers of siding members 150 installed with the aid of the apparatus 100. As previously described, a first siding layer comprised of a siding member 150 is installed on a sidewall construction 50. One or more of the apparatus 100 is attached to the top edge 153 of the siding member 150 comprising the first siding layer. Once the apparatus 100 is attached to the top edge 153 of the siding member 150, and the apparatus 100 and the siding member 150 are nailed using nails 75 to the sidewall construction, the adjoining siding members 150 comprising the second siding layer 150 (FIG. 6) can be installed on the sidewall construction 50 with the aid of the apparatus 100. The process is then repeated by attaching more of the apparatuses 100 to another siding layer on top of the previously installed siding layer until the entire sidewall construction 50 has been covered with successive horizontal siding layers comprising the siding members 150.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. An apparatus for aiding in the installation and sealing of successive layers of partially overlapping rows of horizontally oriented elongated siding members on a sidewall construction, comprising:

a planar body comprising a first face and an opposing second face delimited by opposing third and fourth peripheral edges;

at least two distinct first channel structures each forming a first u-shaped recess for receiving and retaining a bottom edge of a first or second abutting siding member when said apparatus is in use, said first channel structures extending in a first direction transverse to said first face adjacent to said fourth peripheral edge;

a second channel structure provided for hanging said apparatus from a top edge of a third siding member when said apparatus is in use, said second channel structure defining a second u-shaped recess sized and shaped for receiving said top edge therein, and extending transverse to said second face in a second direction opposed from said first direction, said second channel parallel to said first channel structures and located a predetermined distance between said third and fourth peripheral edges of said planar body; and a resilient strip provided for maintaining a moisture impervious seal between said first and second abutting siding members when said apparatus is in use, said resilient strip disposed on said first face so as to extend from said third peripheral edge to said fourth peripheral edge.

2. The apparatus of claim 1, wherein said resilient strip divides the planar body into symmetric first and second portions.

3. The apparatus of claim 2, wherein said resilient strip is comprised of a resilient material that is a member of the group consisting of butyl rubber or a polymer.

4. The apparatus of claim 2, wherein one of said first channel structures extends outwardly and upwardly from the first portion along the fourth peripheral edge of the planar body.

5. The apparatus of claim 2, wherein one of said first channel structures extends outwardly and upwardly from the second portion along the fourth peripheral edge of the planar body.

6. The apparatus of claim 1, wherein said predetermined distance is in a range from between greater than zero to a distance less than the distance between the third and fourth peripheral edges of the planar body.

7. The apparatus of claim 1, wherein said second channel is disposed a distance in the range of greater than zero inches to one and one-eighth inches from the fourth peripheral edge of said planar body.

8. The apparatus of claim 1, wherein said planar body, said first channel structures, and said second channel are comprised of a material that is a member of the group consisting of plastic, metal and composite.

9. The apparatus of claim 1, further comprising a sealing member disposed adjacent to at least one of said second channel, a first one of said first channel structures, and said second one of said first channel structures.

10. The apparatus of claim 9, wherein said sealing member is an adhesive strip with a peel-off backing.

11. An apparatus for aiding in the installation and sealing of successive layers of partially overlapping rows of horizontally oriented elongated siding members on a sidewall construction, comprising:

a planar body comprising a first face and an opposing second face delimited by opposing third and fourth peripheral edges;

a resilient strip provided for maintaining a moisture impervious seal between a first siding member and second abutting siding member when said apparatus is in use, said resilient strip disposed vertically on said first face of the planar body so as to extend from said third peripheral edge to said fourth peripheral edge and to divide the planar body into symmetric first and second portions;

a first channel structure forming a first u-shaped recess for receiving and retaining a first bottom edge of said first siding member when said apparatus is in use, said first channel structure extending in a first direction transverse to said first face adjacent to said fourth peripheral edge;

a second channel structure forming a second u-shaped recess for receiving and retaining a second bottom edge of said second siding member when said apparatus is in use, said second channel structure extending in said first direction transverse to said first face adjacent to said fourth peripheral edge;

a third channel structure provided for hanging said apparatus from a top edge of a third siding member when said apparatus is in use, said third channel structure defining a third u-shaped recess sized and shaped for receiving said top edge therein, and extending transverse to said second face in a second direction opposed from said first direction, said second channel structure parallel to said first and second channel structures and located a predetermined distance between said third and fourth peripheral edges of said planar body; and a first adhesive sealing member disposed on said second face extending adjacent to said third channel structure.

12. The apparatus of claim 11, wherein said resilient strip is comprised of a resilient material that is a member of the group consisting of butyl rubber or a polymer.

13. The apparatus of claim 11, wherein said third channel structure is disposed a predetermined distance from the third peripheral edge of said planar body in a range from between greater than zero to a distance less than the distance between the third and fourth peripheral edges of the planar body.

14. The apparatus of claim 11, wherein said third channel structure is disposed a predetermined distance in the range of greater than zero inches to one and one-eighth inches from the fourth peripheral edge of said planar body.

15. The apparatus of claim 11, wherein said planar body, said first channel structure, said second channel structure, and said third channel structure are comprised of a material that is a member of the group consisting of plastic, metal and composite.

16. The apparatus of claim 11, further comprising a second adhesive sealing member disposed on said first face extending adjacent to said first channel structure.

17. The apparatus of claim 16, further comprising a third adhesive sealing member disposed on said first face extending adjacent to said second channel structure.

18. The apparatus of claim 17, wherein at least one of said first, second, and third sealing members is an adhesive strip with a peel-off backing.

19. The apparatus of claim 17, wherein said first, second, and third adhesive sealing members are positioned on said planar body to align with overlapping portions of said elongated siding members when said apparatus is in use to form a horizontal seal between said overlapping portions of said elongated siding members.

* * * * *